US006484738B1

(12) United States Patent
Andrews et al.

(10) Patent No.: US 6,484,738 B1
(45) Date of Patent: Nov. 26, 2002

(54) DISHWASHING MACHINE WITH CONVENIENT PUMP/MOTOR ACCESS

(75) Inventors: James T. Andrews, Leawood, KS (US); Russell L. Payzant, Olathe, KS (US)

(73) Assignee: TCA, Inc., Edwardsville, KS (US)

( * ) Notice: Subject to any disclaimer, the term of this patent is extended or adjusted under 35 U.S.C. 154(b) by 121 days.

(21) Appl. No.: 09/717,190

(22) Filed: Nov. 21, 2000

(51) Int. Cl.[7] ..... B08B 3/02
(52) U.S. Cl. ..... 134/201; 68/3 R; 68/184
(58) Field of Search ..... 68/3 R, 184, 181 R; 134/188, 201, 186; 417/361, 360, 423.15; 415/912; 15/412

(56) References Cited

U.S. PATENT DOCUMENTS 1,932,246 A * 10/1933 Kirby
2,526,982 A * 10/1950 Vonk
2,970,819 A * 2/1961 Kleebauer
3,108,607 A * 10/1963 Blakeslee
3,776,246 A * 12/1973 Ballard
3,777,989 A * 12/1973 Pacella et al.
3,785,566 A * 1/1974 Jenkins
3,798,931 A * 3/1974 Czech et al.
3,825,373 A * 7/1974 Jenkins
3,978,874 A * 9/1976 Schmidt, Sr. et al.
4,060,346 A * 11/1977 Meyers
4,306,841 A * 12/1981 Morrison et al.
4,462,415 A * 7/1984 Otzen
5,649,557 A * 7/1997 Usher
5,775,347 A * 7/1998 Hoover et al.
6,141,995 A * 11/2000 Johnson

* cited by examiner

*Primary Examiner*—Frankie L. Stinson
(74) *Attorney, Agent, or Firm*—Shook, Hardy & Bacon, LL

(57) ABSTRACT

A dishwashing machine constructed to allow quick and easy removal and replacement of the pump/motor used to pump liquid to the spray system. The pump/motor is mounted at a back comer area of the dishwasher cabinet on a track which angles to the center front area of the cabinet. Quick disconnect couplings allow the pump to be disconnected from the piping so that the pump/motor can be slid along the track and removed out the front of the cabinet. Each coupling includes a sealing sleeve located at a pipe joint and a clamp that can be tightened to seal the sleeve against the pipes. The couplings can be loosened by loosening nuts which release the clamps.

20 Claims, 1 Drawing Sheet

DISHWASHING MACHINE WITH CONVENIENT PUMP/MOTOR ACCESS

FIELD OF THE INVENTION

This invention relates generally to dishwashing equipment and more particularly to a dishwashing machine which is specially constructed to provide easy removal of the pump/motor unit for servicing.

BACKGROUND OF THE INVENTION

In dishwashing machines used in restaurants and other commercial and institutional facilities, the liquid for washing and rinsing the dishware is applied by one or more spray arms. A pump driven by an electric motor supplies the liquid to the spray arms. There are various types of dishwashing machines that are used in this type of application, including conveyor machines, self standing machines and under counter machines. In each type of machine, the motor is the subject of the majority of service calls.

Removing and servicing the motor is a major maintenance undertaking. The motor is usually bolted to the pump and bolted down to the cabinet frame, typically in the back corner area of a motor compartment located at the bottom of the dishwasher cabinet. In order to remove the pump and motor as a unit, it is necessary to disconnect the inlet and discharge piping leading to and from the pump, which is a difficult task in itself. Then, the bolts securing the motor to the cabinet must be reached and removed to release the motor. Electrical wiring must also be disconnected or otherwise dealt with. Because the motor typically weighs 50 pounds or more, it is difficult to lift out of the cabinet even after it has been disconnected. Access to the bolts for the motor is impaired because the most practical location for the motor is in the back corner area of the motor compartment. In addition, there are numerous other components located in the motor compartment, and they must be worked around and cleared when the motor is pulled out. Adding to the accessibility problem is the common practice of installing the dishwasher under counters or tables that may extend up to two feet or more beyond the dishwasher cabinet. Often, large tables must be disassembled and components such as large scrap boxes must be taken out of the dishwasher cabinet in order to provide room to remove the motor.

At best, service personnel must work on their backs or in another awkward position and try to disconnect the piping, reach the motor mounting bolts to loosen them, and then remove the 50 pound motor for servicing, all while working around obstacles such as hoses, electrical wires, plumbing fittings and scrap boxes. In some cases, the motor can be disconnected from the pump in order to avoid the need to disconnect the piping. However, the bolts that connect the pump to the motor are usually even more difficult to reach while the pump/motor unit is in place. Even if a worker is able to reach and remove the bolts, the motor still must clear the pump in order to allow it to be removed, and the problems of lifting a heavy motor from a relatively inaccessible location are still encountered. Also, it is not always known in advance whether the problem is with the pump or the motor, so both must usually be removed.

The motor can be bolted to hanger straps instead of being bolted down to the cabinet floor. However, the bolts still must be removed, and their accessibility is no easier in a hanging installation than in a bolted down installation. Additionally, the heavy motor must be temporarily supported by blocking or in some other manner so that it will not fall when disconnected from the strapping. Setting up temporary blocking under the motor in a relatively inaccessible location is a difficult task.

After the motor has been removed and repaired or replaced, it must be installed again in the dishwasher cabinet. This can involve even more time and difficulty than its removal. It is not uncommon for the plumbing system to be reconnected improperly or for another mistake to be made that can cause even greater problems and additional down time of the machine. It is typical for one or two hours to be required for removal of the motor and as much or more time to be required to install it after it has been serviced or replaced. In corner areas of counters where disassembly of the counter structure or tables is necessary, up to one-half day can be involved in removing the motor. As can easily be appreciated, this can be a serious detriment to the efficient operation of a restaurant or other facility that has great difficulty going without a dishwasher for time periods this long.

SUMMARY OF THE INVENTION

The present invention is directed to a dishwasher in which the pump/motor unit can be removed more quickly and easily than has been possible in the past. In comparison with existing machines that require up to one-half day for removal of the motor, the pump/motor of the present invention can be removed even by unskilled personnel in 10 minutes at the most.

In accordance with a preferred embodiment of the invention, the pump/motor unit of a dishwashing machine is provided with a base that is mounted on a track along which the pump/motor can slide when it needs to be removed for servicing. The inlet and discharge pipes for the pump are equipped with special quick disconnect couplings that effect watertight seals and yet can be quickly detached so that the motor can be removed. The couplings may include sleeves that normally fit around the pipe joints with adjacent pipes butted together end to end. The sleeves are tightened by clamps which are secured by nuts and bolts. When the bolts are loosened, the couplings can be slid off the end of one pipe to disconnect adjacent pipes and allow the motor to slide out along the track. The track is strategically located and oriented where it allows the pump motor to be mounted in the back corner area of the dishwasher cabinet and yet slide out to the center of the cabinet so it can clear obstacles such as scrap trap boxes and other components in the motor compartment. This is achieved by angling the track from the back corner toward the center of the front of the cabinet where the pump/motor can be most easily lifted out of the machine and most easily replaced after it has been serviced.

Other and further objects of the invention, together with the features of novelty appurtenant thereto, will appear in the course of the following description.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
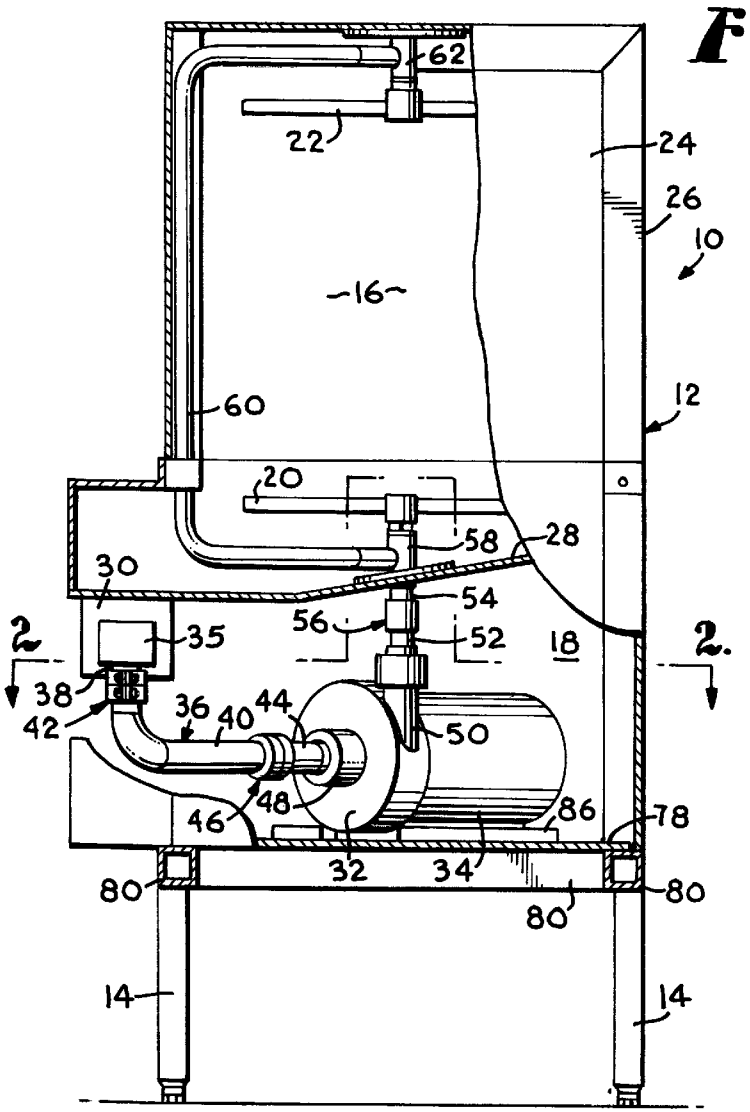
FIG. 1 is a side elevational view of a dishwashing machine equipped with a pump/motor unit that is readily accessible in accordance with a preferred embodiment of the present invention, with portions broken away for purposes of illustration.

Referring now to the drawings in more detail and initially to FIG. 1, numeral 10 generally identifies a dishwashing machine constructed in accordance with a preferred embodiment of the present invention. The machine 10 includes a cabinet 12 which may be mounted on four legs 14. The cabinet 12 has a wash compartment 16 on its upper portion and a motor compartment 18 on its lower portion below the wash compartment 16.

The wash compartment 16 is normally enclosed when the machine is in operation.

Racks of dishware (not shown) may be loaded into the wash compartment 16 above a lower spray arm 20 and below an upper spray arm 22. The wash compartment 16 is provided with opposite side panels 24 and a back panel 26. A hood (not shown) may be closed to cover the front of the wash compartment 16 and may be opened to allow dishware to be loaded into and unloaded from the wash compartment.

Underlying the wash compartment 16 is an inclined floor panel 28 which directs the liquid that is sprayed into the wash compartment downwardly toward a sump 30 located near one of the front comers of the machine 10.

The motor compartment 18 may be open or enclosed and is preferably open at least on its front. The motor compartment 18 contains a pump 32 which is connected to and driven by an electric motor 34. The sump 30 has a drain fitting 35 which is connected with the inlet side of the pump 32 by an inlet conduit assembly generally designated by reference numeral 36. The conduit assembly 36 includes a vertical pipe 38 extending downwardly from the drain fitting 34. An elbow fitting 40 has a vertical portion which is connected with the lower end of pipe 38 by a quick disconnect coupling 42. The elbow fitting 40 has a horizontal portion which is connected at its end with one end of a pump inlet pipe 44. Another quick disconnect coupling 46 establishes the connection between the elbow pipe 40 and the inlet pipe 44. The inlet pipe 44 connects with a pump inlet fitting 48 at the intake side of the pump 32.

The discharge side of the pump 32 has a discharge fitting 50 which connects with the lower end of a pump discharge pipe 52. The discharge pipe 52 is connected at its top end with the lower end of a vertical spray supply conduit 54 which supplies liquid to the spray arms 20 and 22. A quick disconnect coupling 56 is used to make the connection between pipes 52 and 54. The top end of pipe 54 connects with a T-fitting 58 having one outlet supplying liquid to the lower spray arm 20 and the other outlet connected with a pipe assembly 60 that leads to a fitting 62 for the upper spray arm 22.

Figure 4:
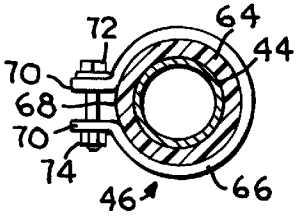
FIG. 4 is a fragmentary sectional view on an enlarged scale taken generally along line 4—4 of FIG. 2 in the direction of the arrows.

One important feature of the present invention is the construction of the quick disconnect couplings 42, 46 and 56 which allows them to be quickly detached to allow disconnection of the motor 34 and pump 32 from the plumbing system of the machine 10. Each of the couplings 42, 46 and 56 has the same construction which is best illustrated in FIG. 4 for the coupling 46. The end of the elbow pipe 40 is butted against the end of the pump intake pipe 44, and these abutting ends are surrounded by a sleeve 64 which fits closely around the adjacent end of the pipes. The sleeve 64 may be constructed of any material suitable to provide a watertight seal and may be a plastic material. Preferably, Teflon® is used to construct the sleeve 64.

The coupling 46 further includes a rigid clamp 66 which extends around and substantially surrounds the sleeve 64. The clamp 66 is generally cylindrical but has a split 68 adjacent to a pair of flanges 70 on opposite sides of the split 68 which face one another and are spaced slightly apart. The clamp 66 may be constructed of stainless steel or another metal or other substance suitable for clamping of the sleeve 64 on the pipes 40 and 44.

A pair of bolts 72 equipped with nuts 74 are extended between the two flanges 70. When the nuts 74 are tightened on the bolts 72, the flanges 70 are squeezed together, thus tightening the clamp 66 around the sleeve 64 to assure that the sleeve provides a watertight seal at the joint between the pipes 40 and 44. When the nuts 74 are loosened sufficiently, the coupling 46 can be slid along the pipes so that it slips off of one of the pipes 40 and 44.

As previously indicated, couplings 42 and 56 have the same construction as coupling 46. When coupling 42 is loosened, it can be slid wholly either onto the elbow pipe 40 or the sump discharge pipe 38. Similarly, when coupling 56 is loosened, it can be slid onto either pipe 52 or pipe 54.

Figure 2:
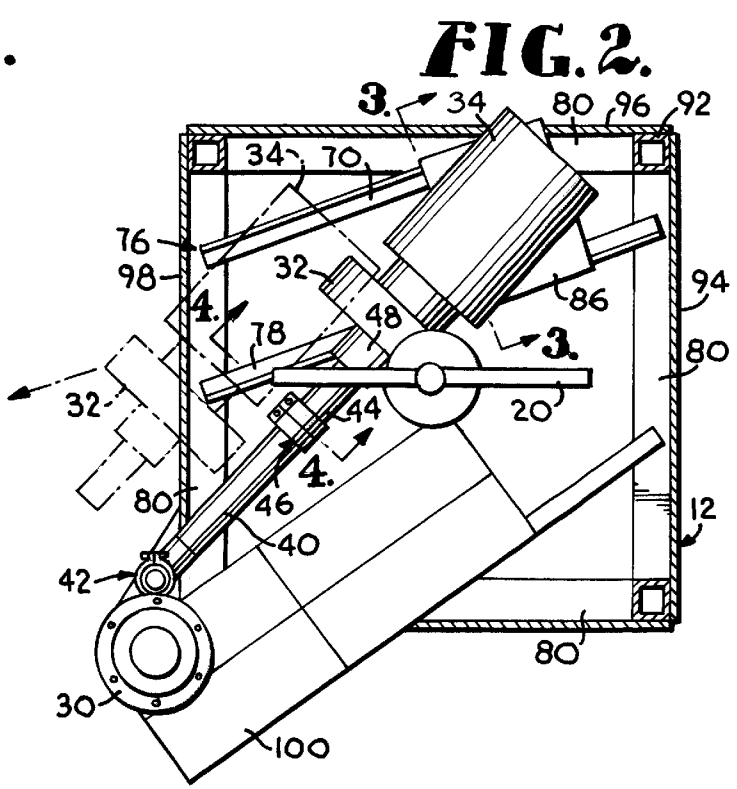
FIG. 2 is a fragmentary sectional view taken generally along line 2—2 of FIG. 1 in the direction of the arrows, with the broken lines showing the pump/motor unit slid to the front of the dishwasher cabinet where it can be removed for servicing.

Another important feature of the invention is the provision of a track on which the pump/motor unit is mounted and may be moved for removal from the machine 10 when necessary for servicing or other reasons. With particular reference to FIG. 2, the track is generally identified by numeral 76 and includes a pair of parallel rails 78 which may take the form of angle members. The rails 78 extend horizontally and are mounted at their ends on horizontal bars 80 which form parts of the frame for the machine 10.

Figure 3:
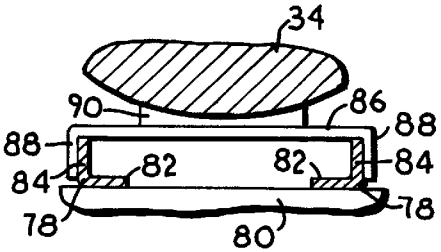
FIG. 3 is a fragmentary sectional view on an enlarged scale taken generally along line 3—3 of FIG. 2 in the direction of the arrows.

As best shown in FIG. 3, each of the rails 78 has a horizontal flange 82 mounted to the bars 80. Each rail 78 also has a vertical flange 84. A flanged base 86 to which the motor 34 and pump 32 are mounted is received on the track 76 with down turned flanges 88 on the opposite edges of the base 86 fitting closely against the outside surfaces of the vertical flanges 84 of rails 78. A bracket 90 on the bottom of the motor 74 is suitably secured on top of the base 86 to mount the motor/pump unit on the base 86.

With reference again to FIG. 2 in particular, the back ends of the rails 78 are located near to one of the rear comer areas 92 of the motor compartment 18 located at the intersection between the back 94 of the motor compartment and one of the sides 96 of the motor compartment. This allows the motor 34 to be located on the track adjacent to the comer 92 when the motor/pump unit is installed in its operating position on the machine. The rails 78 angle away from the side 96 as they extend forwardly. The rails 78 terminate at their forward ends adjacent to the front 98 of the motor compartment 18 which is preferably an open front. The track 76 angles away from side 96 so that the motor/pump unit is located at substantially the center of the open front of the motor compartment 18 when the motor/pump unit is slid forwardly to the broken line position shown in FIG. 2 at the front of the cabinet. The angular orientation of the track 76 is an important feature of the invention because it allows the motor/pump unit to clear obstacles such as a large scrap trap box 100 (FIG. 2) which is located with its front end below the sump 30 of the machine. In addition, the angular orientation of the track 76 and its location on the machine results in the pump/motor unit being located close to the center of the front of the machine where it is most easily lifted out of and replaced on the machine.

In operation of the machine, the motor/pump unit is in the position shown in FIG. 1 and in solid lines in FIG. 2. The pump 32 operates to withdraw liquid from the sump 30 and supply it to the spray arms 20 and 22 so that the spray arms can spray the liquid onto the dishware located in the wash compartment 16.

When it is necessary or desirable to remove the pump 32 and motor 34 from the machine for servicing or other reasons, the nuts 74 of the quick disconnect couplings 42, 46 and 56 are loosened, and each coupling is then slid along the pipes so that the intake and discharge piping is detached from the pump 32. For example, couplings 42 and 46 are preferably loosened and slid onto the elbow pipe 40 so that the entire elbow pipe 40 can be removed from the front area of the pump 32. Coupling 56 is loosened and either slid upwardly onto pipe 54 or downwardly onto pipe 52 to disconnect the joint between the two pipes 52 and 54. The pump 32 and motor 34 can then be slid forwardly along the track 76 to the broken line position shown in FIG. 2 and then lifted out of the motor compartment 18. The electrical wiring (not shown) for the motor 34 is long enough and is provided with sufficient slack to accommodate removal of the motor from the machine 10.

Replacement of the pump 32 and motor 34 as a unit is accomplished by lifting the pump and motor back onto the front portion of the rails 78 to the broken line position shown in FIG. 2. The pump and motor can then be slid along the track 76 to the position shown in solid lines in FIG. 2. With pipes 52 and 54 butted together end to end, the coupling 56 may be slid to a centered position covering the joint between these pipes, and the clamp may be tightened so that the sealing sleeve is squeezed against the pipe joint to provide a liquid tight seal. Similarly, the elbow pipe 40 may be butted end to end against pipe 38 at one end and against pipe 44 at the other end, and the couplings 42 and 46 may be slid to centered positions over the joints between the pipes. The clamps may then be tightened to assure leakproof joints between the pipes of the intake conduit assembly.

It may be desirable in some applications to provide rollers, wheels or some other elements to reduce frictional resistance to sliding of the pump/motor unit along the track 76. The provision of such elements is contemplated by and within the scope of the invention.

It is thus evident that the present invention provides for a significant improvement in the time and effort required to remove and replace the pump/motor unit of a dishwashing machine. At the same time, the construction of the quick disconnect couplings allows the joints between the pipes of the plumbing system to be effectively sealed against leakage. It is noted that all of the quick disconnect couplings are easily accessible and can be tightened and loosened solely with an open end wrench or other conventional tool even by workers having no special skills or training.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A machine for washing dishware, comprising:

a cabinet presenting a wash compartment and a sump for receiving liquid sprayed in the wash compartment;

a spray mechanism for spraying liquid on dishware in the wash compartment;

a pump;

an intake conduit assembly providing a flow path from said sump to said pump, said intake conduit assembly being detachable from the pump;

a discharge conduit assembly providing a flow path from the pump to said spray mechanism, said discharge conduit assembly being detachable from said pump; and a track on said cabinet receiving said pump and allowing the pump to move along said track to a position accessible from the exterior of the cabinet when said intake and discharge conduit assemblies are detached from the pump.

2. A machine as set forth in claim 1, including:

a pair of pipes in said intake conduit assembly arranged end to end;

a sleeve providing a seal between said pipes; and a clamp for securing said sleeve to said pipes to effect a seal between the pipes, said clamp being releaseable to allow disconnection of said pipes for detachment of the intake conduit assembly from the pump.

3. A machine as set forth in claim 2, wherein said clamp includes:

a clamp element substantially surrounding said sleeve; and a detachable fastening element tightening said clamp element on said sleeve.

4. A machine as set forth in claim 2, including:

a pair of conduits in said discharge conduit assembly arranged end to end;

a second sleeve providing a seal between said conduits; and a second clamp for securing said second sleeve to said conduits to effect a seal between the conduits, said second clamp being releaseable to allow disconnection of said conduits for detachment of said discharge conduit assembly.

5. A machine as set forth in claim 4, wherein:

said cabinet has a front and opposite sides; and said track extends to the front of the cabinet to allow removal of the pump from the cabinet at the front thereof.

6. A machine as set forth in claim 2, wherein:

said cabinet has a front and opposite sides; and said track extends to the front of the cabinet to allow removal of the pump from the cabinet at the front thereof.

7. A machine as set forth in claim 1, wherein:

said cabinet has a front and opposite sides; and said track extends to the front of the cabinet to allow removal of the pump from the cabinet at the front thereof.

8. A machine as set forth in claim 7, wherein said track angles away from one of said sides of the cabinet toward the front thereof.

9. A machine as set forth in claim 1, wherein:

said track includes a pair of substantially parallel rails; and said pump is provided with a base mounted on said rails for movement along the rails when said inlet and discharge assemblies are detached from the pump.

10. A machine as set forth in claim 1, including:

a generally horizontal intake pipe in said intake conduit assembly directing liquid to the pump;

a generally vertical sump pipe in said intake conduit assembly directing liquid from the sump;

an elbow pipe in said intake conduit assembly extending between said sump pipe and said intake pipe, said elbow pipe having one end arranged end to end with said sump pipe and another end arranged end to end with said intake pipe;

a first detachable seal element between the adjacent ends of said sump pipe and elbow pipe providing a seal therebetween; and a second detachable seal element between the adjacent ends of said intake pipe and elbow pipe providing a seal therebetween, said first and second seal elements being detachable to release said elbow pipe from the intake conduit assembly.

11. A machine as set forth in claim 10, including:

a generally vertical spray supply conduit in said discharge conduit assembly;

a pump discharge conduit in said discharge conduit assembly directing liquid from the pump to said spray supply conduit, said pump discharge conduit being arranged end to end with said spray supply conduit; and a detachable seal member between the adjacent ends of said pump discharge conduit and said spray supply conduit providing a seal therebetween, said seal member being detachable to release said pump discharge conduit from said spray supply conduit.

12. A machine as set forth in claim 1, wherein:

said cabinet has a front and opposite sides; and said track extends to said front of the cabinet and is located approximately midway between said sides adjacent said front.

13. A machine as set forth in claim 12, wherein said track angles away from one of said sides as the track extends toward said front of the cabinet.

14. A dishwashing machine comprising:

a cabinet providing a wash compartment and having a front;

a spray mechanism for spraying liquid in the wash compartment;

a pump having an intake conduit assembly for receiving liquid and a discharge conduit assembly for supplying liquid to the spray mechanism;

a pair of pipes in said intake conduit assembly;

a first detachable coupling sealing said pipes together and being detachable to separate said pipes;

a pair of conduits in said discharge conduit assembly;

a second detachable coupling sealing said conduits together and being detachable to separate said conduits; and a track on said cabinet on which said pump is mounted, said track providing a path along which the pump can slide out the front of the cabinet when said first and second couplings are detached.

15. A machine as set forth in claim 14, wherein said track is arranged at an orientation wherein said path angles away from one side of said cabinet toward the front.

16. A machine as set forth in claim 15, wherein said path terminates at a location approximately centered between opposite sides of the cabinet adjacent the front thereof.

17. A machine as set forth in claim 14, wherein said first detachable coupling comprises:

a sleeve applied to adjacent ends of said pipes to seal the pipes together; and a releaseable clamp applicable to said sleeve to tighten the sleeve on said pipes.

18. A machine as set forth in claim 17, wherein said releaseable clamp comprises:

a clamp element applicable to substantially surround said sleeve; and a releaseable fastener for tightening said clamp element around said sleeve.

19. In a dishwashing machine having a cabinet, a spray mechanism for spraying dishware, a pump for supplying liquid to the spray mechanism, an intake conduit assembly for supplying liquid to the pump, and a discharge conduit assembly for supplying liquid from the pump to the spray mechanism, the improvement comprising:

a detachable coupling in said intake conduit assembly allowing the pump to be disconnected from the intake conduit assembly;

a detachable coupling in said discharge conduit assembly allowing the pump to be disconnected from the discharge conduit assembly; and a track on the cabinet receiving the pump, said track providing a path along which the pump can slide out of the cabinet when said detachable couplings are detached to disconnect the pump from the intake and discharge conduit assemblies.

20. The improvement of claim 19, wherein said path angles away from a side of the cabinet toward a front of the cabinet and terminates adjacent said front.

* * * * *